United States Patent [19]

Itoigawa et al.

[11] Patent Number: 4,616,920

[45] Date of Patent: Oct. 14, 1986

[54] COPYING MACHINE HAVING AN ENDLESS PHOTORECEPTOR BELT

[75] Inventors: Masakatsu Itoigawa, Nara; Masaru Nishijima, Hirakata, both of Japan

[73] Assignee: Sharp Kabushiki Kaisha, Osaka, Japan

[21] Appl. No.: 682,349

[22] Filed: Dec. 17, 1984

[30] Foreign Application Priority Data

| | | | |
|---|---|---|---|
| Dec. 20, 1983 | [JP] | Japan | 58-242549 |
| Dec. 23, 1983 | [JP] | Japan | 58-252161 |
| Dec. 26, 1983 | [JP] | Japan | 58-250750 |
| Dec. 27, 1983 | [JP] | Japan | 58-249984 |

[51] Int. Cl.[4] ..... G03G 15/00

[52] U.S. Cl. ..... 355/3 BE; 355/16

[58] Field of Search ..... 355/3 BE, 16, 3 R, 133

[56] References Cited

U.S. PATENT DOCUMENTS

| | | | |
|---|---|---|---|
| 3,606,532 | 9/1971 | Shelffo et al. | 355/16 X |
| 4,017,169 | 4/1977 | Komura et al. | 355/3 R |
| 4,332,458 | 6/1982 | Hoffman | 355/3 BE |
| 4,470,690 | 9/1984 | Hoffman | 355/16 X |

FOREIGN PATENT DOCUMENTS

| | | |
|---|---|---|
| 3301124 | 7/1983 | Fed. Rep. of Germany . |
| 55-93184 | 7/1980 | Japan . |
| 56-40827 | 9/1981 | Japan . |

*Primary Examiner*—R. L. Moses

*Attorney, Agent, or Firm*—Birch, Stewart, Kolasch & Birch

[57] ABSTRACT

A copying machine has a roller unit which includes a driving roller and an idler roller which are positioned substantially parallel to each other. The roller unit has opposite ends in the axial direction of the rollers, and is supported in a housing of the copying machine at one end thereof. An endless photoreceptor belt is mounted on the rollers. A lid member is provided to the housing movably between an attached position and a detached position. When the lid member is moved to the attached position, the other end of the roller unit is supported by the lid member and, when it is moved to the detached position, the other end of the roller unit is freed, thereby enabling the removal and mounting of the endless photoreceptor belt in the axial direction of the rollers during the lid member is in the detached position.

13 Claims, 18 Drawing Figures

COPYING MACHINE HAVING AN ENDLESS PHOTORECEPTOR BELT

BACKGROUND OF THE INVENTION

1. Field of the Invention

The present invention relates to an electrostatic copying machine having a photoreceptor of an endless belt type and, more particularly, to an arrangement thereof for the easy exchange of the photoreceptor belt.

2. Description of the Prior Art

According to the prior art copying machine of the above described type, such as disclosed in U.S. Pat. No. 4,332,458, it is a time consuming task to exchange the endless belt. According to U.S. Pat. No. 4,332,458, the photoreceptor belt is mounted extendingly on the large diameter roller and the small diameter roller in a teardrop cross section.

When it is necessary to exchange the photoreceptor belt, the operator first must bring the copying machine to an open space. Then, he draws out the rollers and photoreceptor belt together with the associated parts in a direction perpendicular to the axis of the rollers from the housing of the copying machine in a manner similar to a match box. If there is a cover provided around the photoreceptor belt to protect it form the external lights, the operator must open the cover. Then, he releases the tension on the photoreceptor belt by narrowing the distance between the large and small rollers. Since the rollers are supported in cantilever fashion, the photorecepter belt is removed in the axial direction of rollers.

When a new photoreceptor belt is mounted, the rollers are stretched out again to provide tension to the new photoreceptor belt. Then, the light protection cover is closed and, thereafter, the drawer is pushed back into the housing.

The prior art copying machine has a problem in the quality of the reproduced image on a copy paper, and also a problem in difficulty in exchanging the photoreceptor belt.

Specifically, since the rollers are supported in cantilever fashion, they are susceptible to external forces applied thereto in the direction perpendicular to the axis, particularly at the free ends thereof. Therefore, after a long period of use, the rollers may not be maintained in the required positions, resulting in unevn lighting of the original image on the photoreceptor surface or in deflection of the reproduced image. Although this may be improved by forming the cantilever arrangement with a stiff material, the copy machine becomes bulky and expensive.

Furthermore, when the new photoreceptor belt is mounted, one may set up the copying machine in a condition ready for taking copies with the belt not completely mounted. In such a case, a part of the image may not be reproduced, or the copying operation may not start in the case when there is a detector that detects the condition of the mounted photoreceptor belt.

Moreover, since there are a number of steps that have to be carried out to complete the photoreceptor belt exchange, one may forget to do some of the steps. For example, one may forget to stretch out the rollers after the new photoreceptor belt is mounted to provide a tension to the belt, or one may forget to close the light protection cover. In such a case, parts, such as cover and belt, may be damaged, and/or the reproduced image will be in a very poor condition.

SUMMARY OF THE INVENTION

The present invention has been developed with a view to substantially solving the above described disadvantages and has as an object to provide an improved copying machine which can carry out the photoreceptor belt exchange in a simple steps without requiring much extra space.

In accomplishing these and other objects, a copying machine according to the present invention comprises a roller unit which includes a driving roller and an idler roller which are positioned substantially parallel to each other. The roller unit has opposite ends in the axial direction of the rollers and is supported in a housing of the copying machine at one end thereof. An endless photoreceptor belt is mounted on the rollers. A lid member is provided to the housing movably between an attached position and a detached position. When the lid member is moved to the attached position, the other end of the roller unit is supported by the lid member and, when it is moved to the detached position, the other end of the roller unit is freed, thereby enabling the removal and mounting of the endless photoreceptor belt in the axial direction of the rollers while the lid member is in the detached position.

BRIEF DESCRIPTION OF THE DRAWINGS

These and other objects and features of the present invention will become apparent from the following description taken in conjunction with a preferred embodiment thereof with reference to the accompanying drawings, throughout which like parts are designated by like reference numerals, and in which.

DESCRIPTION OF THE PREFERRED EMBODIMENTS

Figure 1:
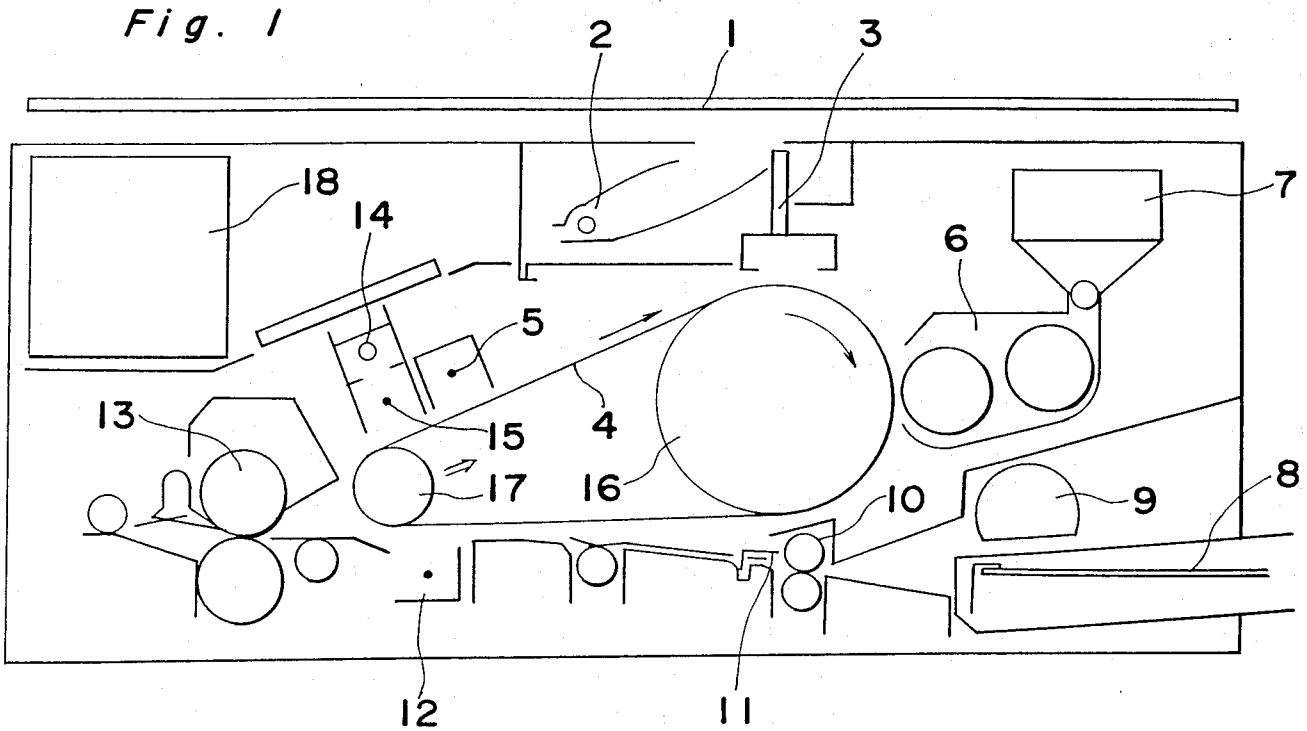
FIG. 1 is a side elevation diagrammatic view of an electrostatic copying machine according to the present invention.

Referring to FIG. 1, a copying machine to which the present invention is applied is shown. The copying machine comprises a movable platen 1 on which an original to be copied is placed, a lamp 2 for uniformly lighting the original, and an optical arrangement 3, including a SELFOC lens, for transmitting an image of the original to an exposure station at which a light pattern of the original is projected onto a surface of a photoreceptor belt 4 (master M), thereby forming a latent electrostatic image of the original on the photoreceptor surface. Photoreceptor belt 4 is an endless belt mounted between a large roller 16 and a small roller 17 to move in the direction indicated by the arrow so as to sequentially pass a plurality of processing stations described below. Roller 16 and 17 are positioned parallel or slightly slanted to each other. Generally speaking, they are substantially parallel to each other.

Positioned before the exposure station is a charging station defined by a corona discharge electrode 5 which extend across photoreceptor belt 4 so that the photoreceptor surface is uniformly deposited with electrostatic charges.

At the exposure station, the charges in the exposed area on the photoreceptor surface are dissipated, thereby forming a latent electrostatic image.

A developing station is defined by a developer/cleaning device 6 which cascades toner particles having an electrostatic charge opposite to that of the electrostatic latent image over the photoreceptor surface, whereby the toner particles adhere to the electrostatic latent image to form a powdered image in the configuration of the copy to be made. Developer/cleaning device 6 is provided with a toner supply cartridge 7.

Then, at a transfer station, the toner powder image is electrostatically transferred from the photoreceptor surface to a copy sheet which has been taken out from a casette 8 by a supply roller 9 and advanced by a pair of feed rollers 10. Supply roller 9 is actuated in response to a copy material supply signal from a control unit (not shown) which sequentially controls the copying operation. A sheet registration device 11 is provided which arrests and aligns each individual sheet of copy material in a timed relationship with the movement of the photoreceptor belt 4 so as to coincide the tip of the sheet of copy material with the tip of the image to be transferred. The transfer of the toner powder image to the copy material is actually done by a corona transfer device 12 which produces an electrostatic field that is effective to attract the toner particles comprising the powder image from the photoreceptor surface and cause them to adhere electrostatically to the surface of the copy material.

Figure 2:
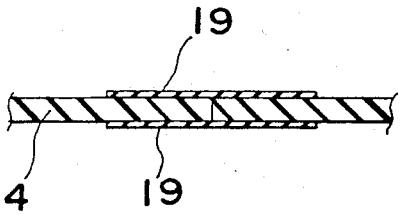
FIG. 2 is a fragmentary partial view showing a joint of an endless belt.

A stripping apparatus (not shown) is provided subsequent to the transfer station to remove the sheets of copy material from the photoreceptor surface. The removed sheets of copy material are advanced to a fixer roller 13 at which the powder image is permanently fixed on the copy material, and in turn, are ejected to a tray 25 (FIG. 2).

A discharge station is defined by a discharge lamp 14 and a discharge apparatus 15. At this station, the photoreceptor surface is exposed to a relatively bright light to effect substantially complete discharge of any residual electrostatic charge remaining thereon.

The electrostatic belt is further moved past the exposure station to a cleaning station defined by developer/cleaning device 6. At this station, the photoreceptor surface is brushed to remove residual toner particles remaining thereon.

Figure 12:
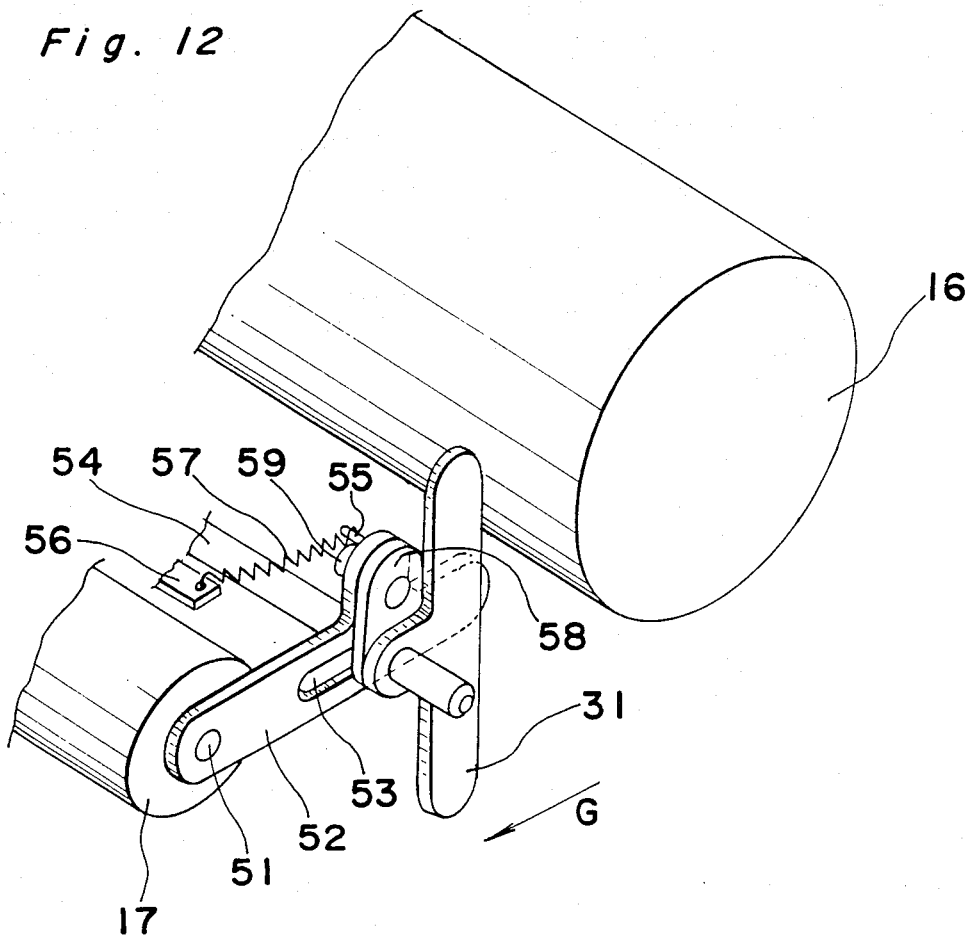
FIG. 12 is a perspective fragmentary view of the tension level and its associated parts.
Figure 17:
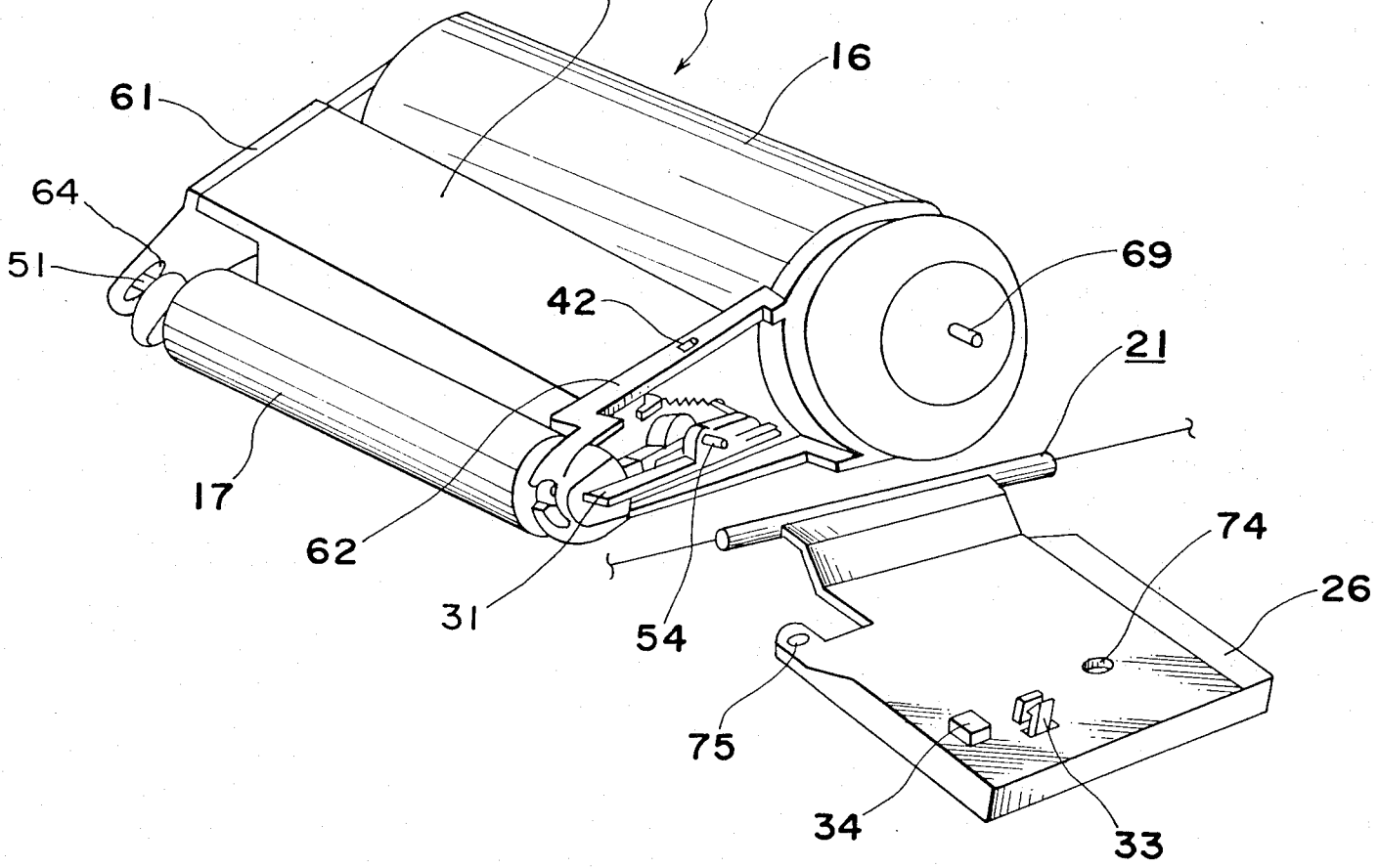
FIG. 17 is a diagrammatic view showing an arrangement for supporting rollers on which the endless photoreceptor belt is provided.

Photoreceptor belt 4 is supported on a relatively large diameter drive roller 16 and a relatively small diameter idler roller 17 which are spaced from each other with a predetermined tension applied on belt 4. Drive roller 16 is connected to a main motor 18 through a suitable connecting means. Idler roller 17 is connected to a tension level 31, as best shown in FIG. 12, so as to enable the idler roller 17 to move towards the drive roller 16 in the direction indicated by the arrow, thereby permitting the exhcange of photoreceptor belt 14. An arrangement defined by rollers 16 and 17 and their associated parts are referred to as a roller unit 24, which is best shown in FIG. 17.

Photoreceptor belt 4 is originally a long strip of belt having opposite ends. The opposite ends are connected with each other by a suitable connecting plate 19, as shown in FIG. 2. Photoreceptor belt 4 has some resiliency, and since it is provided in an endless belt form, the application and removal of the photoreceptor belt 4 on rollers 16 and 17 can be done easily. Furthermore, by the action of tension level 31, which will be described later, photoreceptor belt 4 tightly extends between rollers 16 and 17, thereby maintaining belt 4 tightly on rollers 16 and 17. Unlike the belt shown in FIG. 2, a seamless belt can be used.

Figure 3:
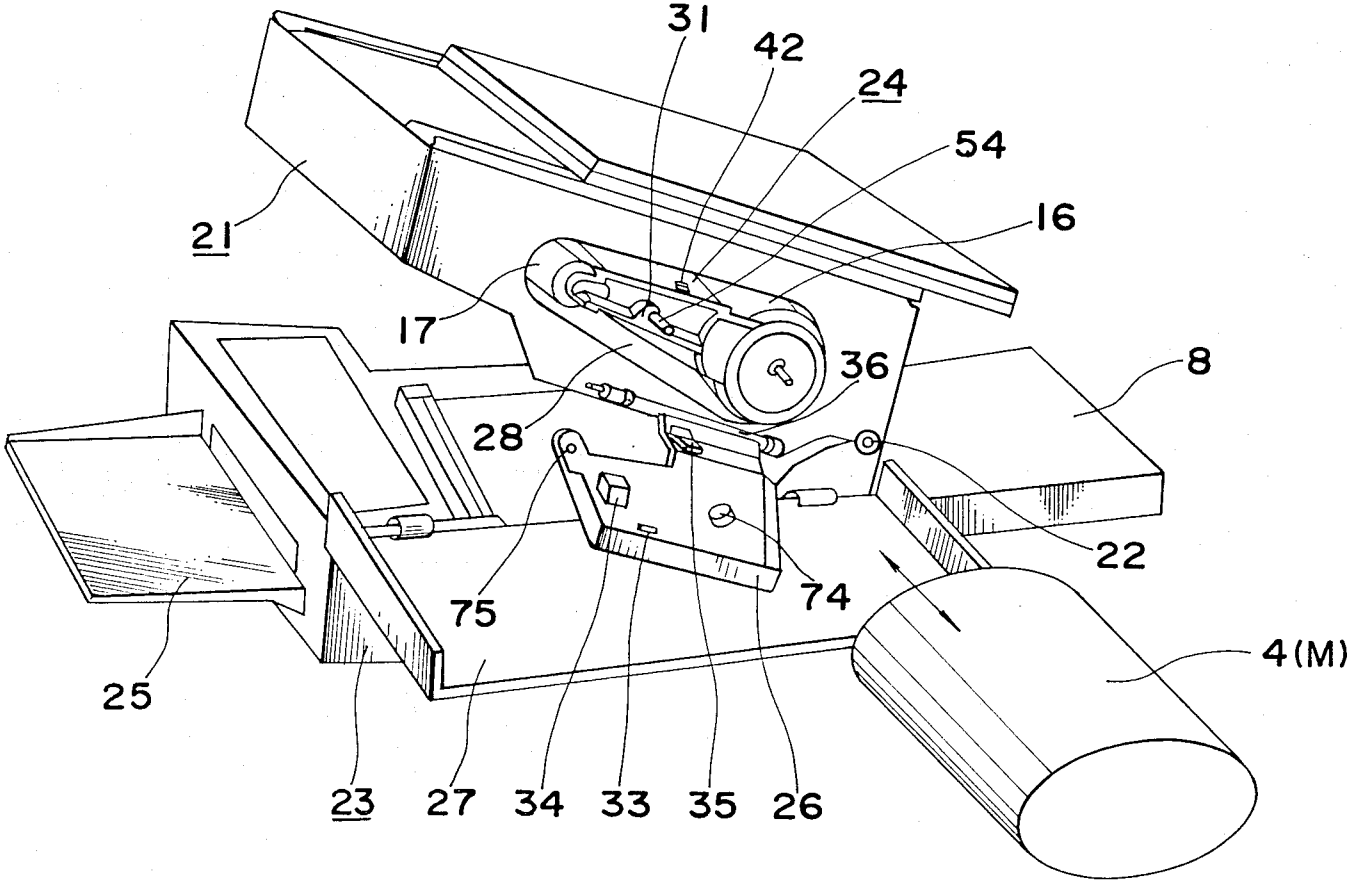
FIG. 3 is a perspective view of the electrostatic copying machine according to the present invention.

Referring to FIG. 3, a copying machine according to the present invention is shown, which can be divided into an upper compartment and a lower compartment.

The upper compartment is defined by an upper frame 21 which is connected to a lower frame 23 of the lower compartment in a hinged manner using an axle 22. The upper compartment is held in the open condition, as shown in FIG. 3, by a suitable spring means (not shown).

The upper compartment contains platen 1, lamp 2, optical arrangement 3, corona discharge electrode 5, developer/cleaning device 6, toner supply cartridge 7, discharge lamp 14, discharge apparatus 15 and roller unit 24. The lower compartment contains casette 8, supply roller 9, feed rollers 10, sheet registration device 11, corona transfer device 12, fixer roller 13, and tray 25. The upper and lower compartments are separated along the path of the copy material.

Upper frame 21 of the upper compartment is formed with an opening 28 which permits an operator to have access to roller unit 24 and to exchange photoreceptor belt 4. A lid 26 is provided pivotally on a shaft 36, which extends on the outside surface of upper frame 21 immediately below opening 28, so that lid 26 can cover opening 28, thereby cutting light that falls onto roller unit 24 from outside. Lid 26 has a lower portion partly removed to permit the operator to have access to a tension lever 31 even when lid 26 is closed. The tension lever 31 will be described in detail later in connection with FIGS. 4, 5, and 12–16. A cover 27 is pivotally connected to lower frame 23 so as to entirely cover the side surface of the upper compartment.

Figure 4:
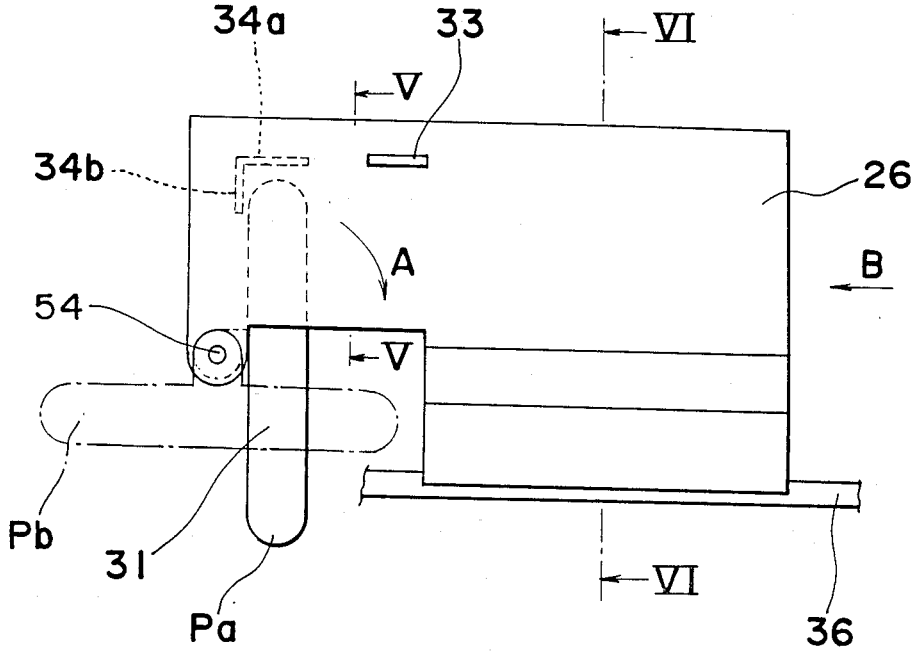
FIG. 4 is an elevation view of a lid provided with a tension level.

According to a preferred embodiment of the present invention, photoreceptor belt 4 is exchanged in the following steps. First, cover 27 is opened. Then, the upper compartment is pivotally moved upwardly about axle 22 to separate the upper and lower compartments. Thereafter, a tension lever 31, which is now in the vertical position Pa as shown by a real line in FIG. 4, is manually rotated in the direction A about shaft 32 to the horizontal position Pb as shown by a dotted line in FIG. 4. As will be understood from the further description in connection with FIGS. 12–14, the tension is applied to photoreceptor belt 4 when lever 31 is held in the vertical position Pa, and such a tension is removed when lever 31 is held in the horizontal position Pb. FIG. 3 shows tension lever 31 in the horizontal position Pb. Then, lid 26 is opened upon disengaging the lock between a hook arrangement 33 and an opening 42. The detail of the hook arrangement 33 and opening 42 will be described later in connection with FIG. 11. Now the copying machine is in the condition indicated in FIG. 3, ready to exchange the photoreceptor belt.

Figure 5:
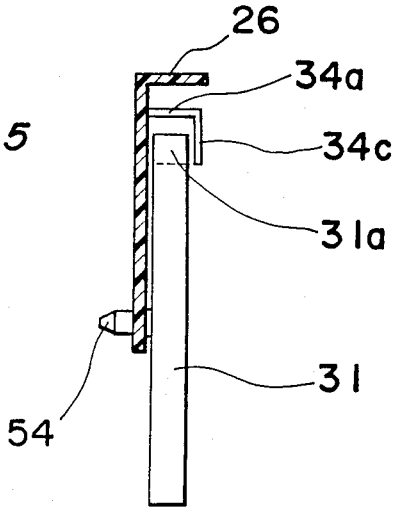
FIG. 5 is a cross-sectional view taken along a line V—V shown in FIG. 4.

Lid 26 is so arranged that it will not open unless tension lever 31 is tilted in the horizontal position Pb. When tension lever 31 is in the vertical position Pa, an upper end 31*a* of lever 31 is accommodated in a pocket defined by three walls 34*a*, 34*b* and 34*c*. When lid 26 is closed with tension lever 21 in the vertical position Pa, the engagement between upper end 31*a* and wall 34*c* prevents lid 26 from being opened, as shown in FIG. 5. Therefore, when lid 26 is being opened, it is understood that tension lever 31 is already tilted in the horizontal position Pb. Thus, the tension applied to photoreceptor belt 4 is released, as will be undertstood from the description given in connecton with FIGS. 12–14. Under this condition, the old photoreceptor belt 4 can be pulled out from opening 28, and a new photoreceptor belt 4 can be inserted.

Figure 6:
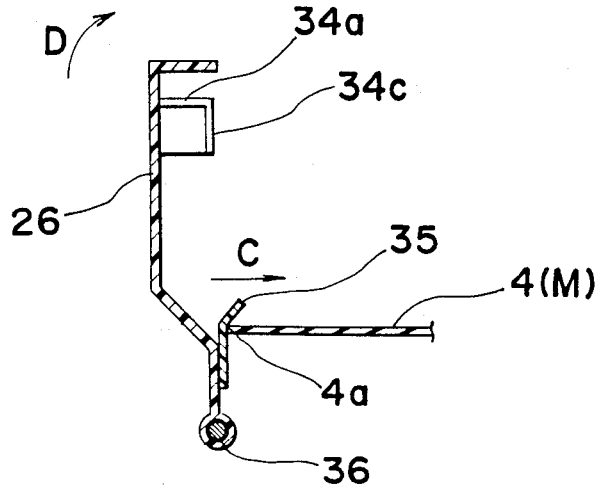
FIG. 6 is cross-sectional view taken along a line VI—VI shown in FIG. 4.

Referring to FIG. 6, lid 26 further has on the lower portion of its inner surface a guide plate 35, which, when lid 26 is rotated in the direction D about axle 36 to close the opening 28, pushes the photoreceptor belt 4 at the side 4*a* thereof in the direction C, thereby positioning the belt 4 in the properly inserted position. Therefore, even when belt 4 is not fully inserted, such as when it is replaced with a new one, the belt 4 can be forcibly inserted into the proper position by guide plate 35.

Figure 7:
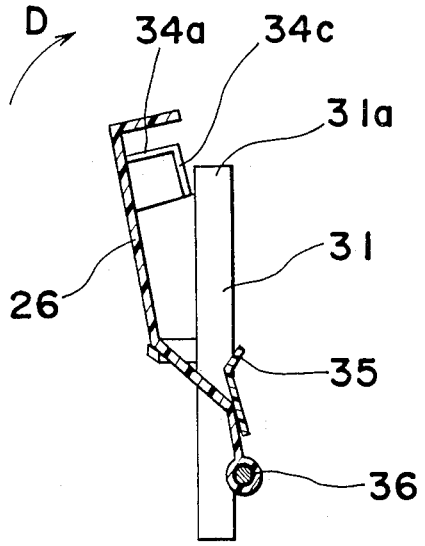
FIG. 7 is a view similar to FIG. 6, but is showing a case when the lid closes unsuccessfully.

Lid 26 is so arranged that it will not close unless tension lever 31 is held in the horizontal position Pb. If tension lever 31 is turned to the vertical position Pa before closing lid 26, wall 34*a* comes into contact with end 31*a* of lever 31, as indicated in FIG. 7, thereby preventing the further rotation of lid 26 in the direction D. By this arrangement, lid 26 closes only when tension lever 31 is held in the horizontal position, that is when photoreceptor belt 4 is freed from the tension. Thus, when lid 26 closes, photoreceptor belt 4 is always in the tension released condition, thereby permitting the proper positioning of photoreceptor belt 4 by guide plate 35.

According to the preferred embodiment, guide plate 35 is formed by a polyethylene terephthalate (P.E.T.) plate having a thickness of 0.2 millimeter.

Thus, the proper steps to close lid 26 and to turn tension lever 31 are: first lid 26 is closed and then the tension lever is turned from the horizontal position Pb to the vertical position Pa.

Next, upper frame 21 is pushed down until it engages with lower frame 23 and, thereafter, side cover 27 is closed, thereby completing the set up of the copying machine.

According to the present invention, when setting up the copying machine, lid 26 can be closed and lever 31 can be turned from the horizontal position Pa to vertical position Pb in the proper order automatically upon closing of upper frame 21 onto lower frame 23. The mechanism for effecting such automatic movements of lid 26 and lever 31 will be described hereinbelow.

Figure 8:
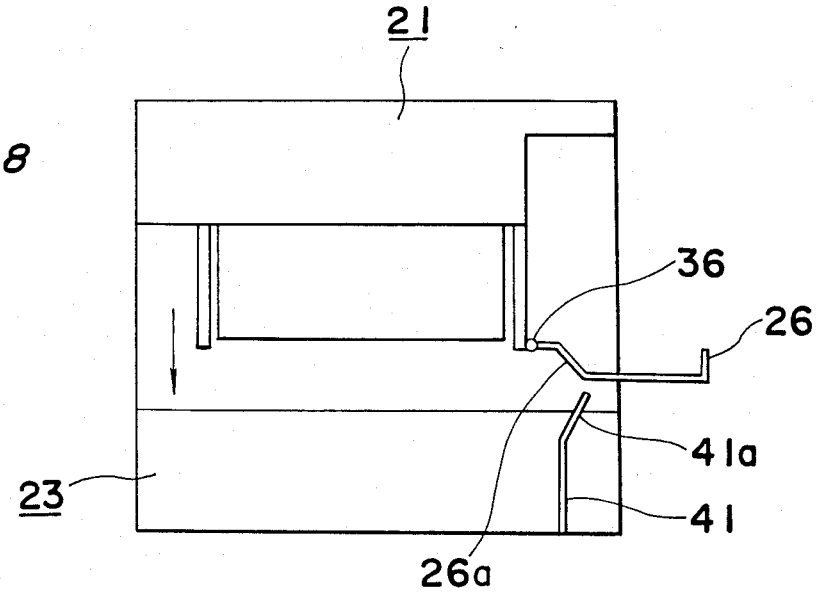
FIGS. 8, 9 and 10 show front elevational views of the electrostatic copying machine according to the present invention, particularly showing the steps to close the lid during the installation of the upper compartment onto the lower compartment.

Referring to FIG. 8, lower frame 23 is provided with an upright wall 41 at a position adjacent the path of axle 36. Upright wall 41 extends upwardly from the bottom of lower frame 23 and has a lower portion 41*b* which is perpendicular to the bottom wall of lower frame 23 and an upper end portion 41*a* which is slanted with respect to lower portion 41*b*.

Figure 9:
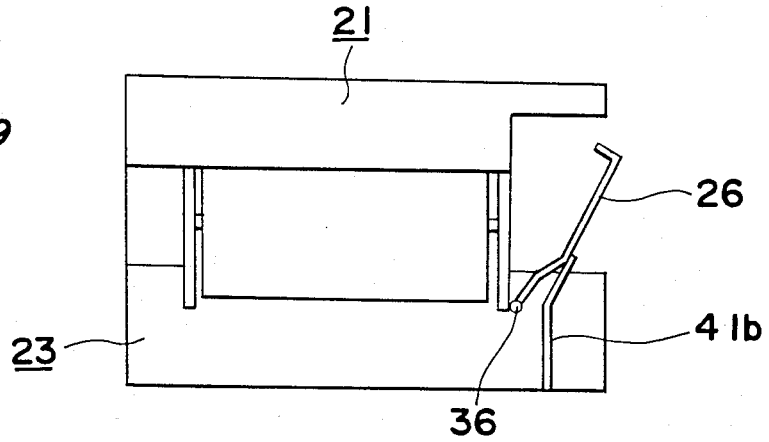
Figure 10:
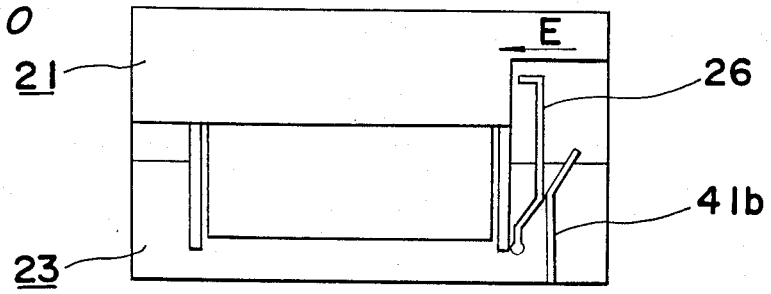

Assuming that the upper frame 21 is open, and when it is pushed down in the direction indicated by an arrow in FIG. 8, the upper edge of the upright wall 41 comes into contact with lid 26, thereby effecting the counterclockwise rotation of lid 26. When upper frame 21 is further pushed down, a slanted face 26*a* of lid 26 comes into contact with upper end portion 41*a* so as to further rotate lid 26 counterclockwise (FIG. 9). Finally, lower portion 41*b* comes into contact with lid 26 so as to close lid 26 completely, as shown in FIG. 10.

By the above arrangement, lid 26 can be closed even when the operator forgets to close it when setting up the copying machine.

When lid 26 is completely closed, hook arrangement 33 engages with opening 42 so as to maintain lid 26 in the closed position. The detail of hook arrangement 33 is decribed hereinbelow.

Figure 11:
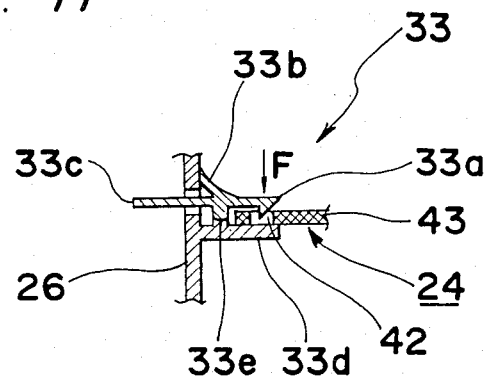
FIG. 11 is a lock arrangement of the lid.

Referring to FIG. 11, hook arrangement 33 comprises a support 33*d* extending perpendicularly from lid 26. An elongated plate 33*c* is provided. One end portion of elongated plate 33*c* extends through lid 26 and is located on one side of lid 26, i.e., at the outside of the upper compartment. The other end portion of elongated plate 33*c* is located on the other side of lid 26 and is provided with a hook 33*a*. Elongated plate 33*c* has a leg 33*e* extending downwardly from an intermediate portion thereof and is connected to support 33*d*. Elongated plate 33*c* further has a bar 33*b* extending upwardly but diagonally towards the inside face of lid 26. By the resilience of leg 33*c*, elongated plate 33*c* can move in a see-saw manner. Also, by the resiliency of bar 33*b*, elongated plate 33*c* is forced to return to the position indicated in FIG. 11, particularly when an external force is applied so as to turn the elongated plate 33*c* about leg 33*e* in the direction opposite to the arrow F. Roller unit 24 has a plate 43 which is provided with opening 42 for the engagement with hook 33*a*. To release the engagement between hook 33*a* and opening 42, the left end portion of elongated plate 33*c*, when viewed in FIG. 11, is pushed down. And, the left end portion of elongated plate 33*c* is pulled towards the left to disengage the hook from the opening.

Next, the arrangement for applying tension to photoreceptor belt 4 is described. According to the preferred embodiment, the tension is applied by the increase of the distance between two rollers 16 and 17, and the application of the tension is effected by tension lever 31 and its associated parts, which will be described.

Figure 13:
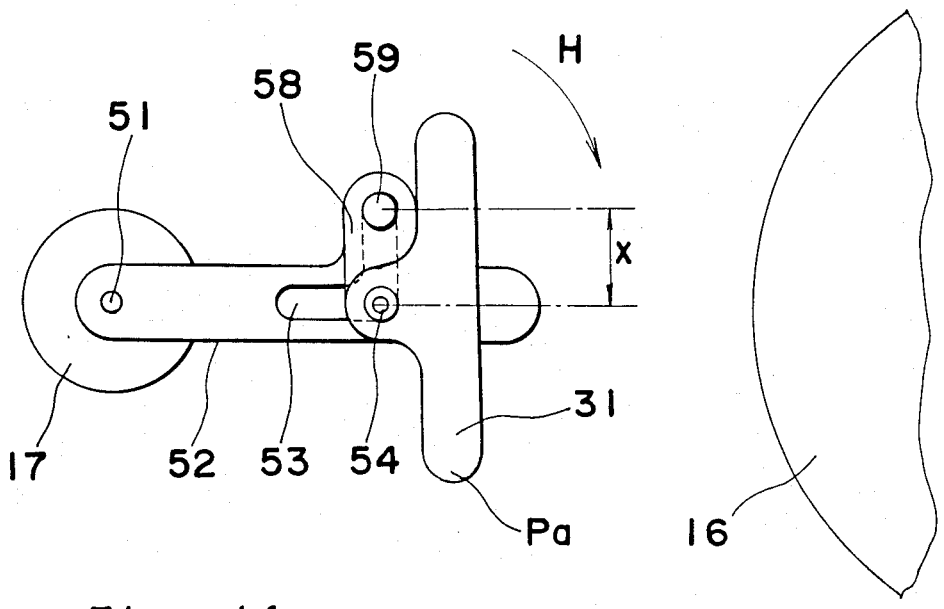
FIGS. 13 and 14 are side elevational views of the tension level and its associated parts, and particularly showing a tension applied position and tension released position, respectively.
Figure 18:
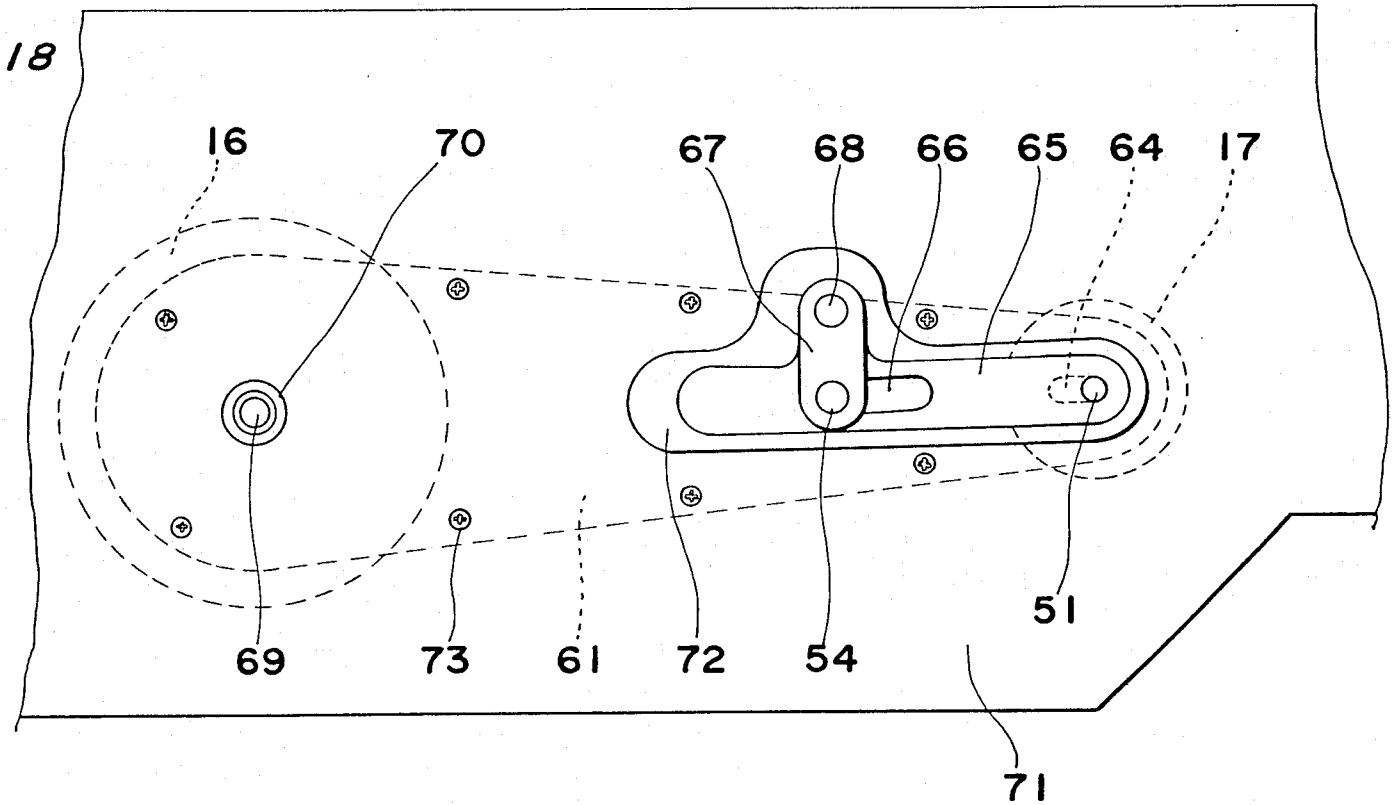
FIG. 18 is a side elevational view taken from the opposite side of the electrostatic copying machine.

Referring to FIG. 12, lever 31 has a center projection which is rigidly connected to one end of a connection bar 58 which extends parallelly to tension lever 31. The connection between tension lever 31 and connection bar 58 is done by a shaft 54, which is firmly provided in roller unit 24 and is stationary with respect to large roller 16. Thus, the distance between large roller 16 and shaft 54 is unchangeable. The connection between connection bar 58 and tension lever 31 is effected firmly so that connection bar 58 and tension lever 31 are firmly held together. Shaft 54 extends through connection bar 58 and is loosely inserted into a guide groove 53, which is formed in a tension plate 52 in a shape of L, as best shown in FIG. 13. The other end of connection bar 58 is provided with a pin projection 59 which is also loosely inserted into the guide groove 53. Tension plate 52 has its end connected to a shaft 51 on which small roller 17 is mounted. A biasing spring 57 is provided between a pin 55 extending from tension plate 52 and a portion 56 which is firmly provided in roller unit 24. Accordingly, tension plate 52 is biased in the direction G by biasing spring 57. As shown in FIG. 18, a structure similar to that described above is provided on the other side of roller unit 24. The only difference is that the arrangement at the other end has no tension lever 31.

Next, the movement of tension lever 31 and its associated parts will be described.

Figure 14:
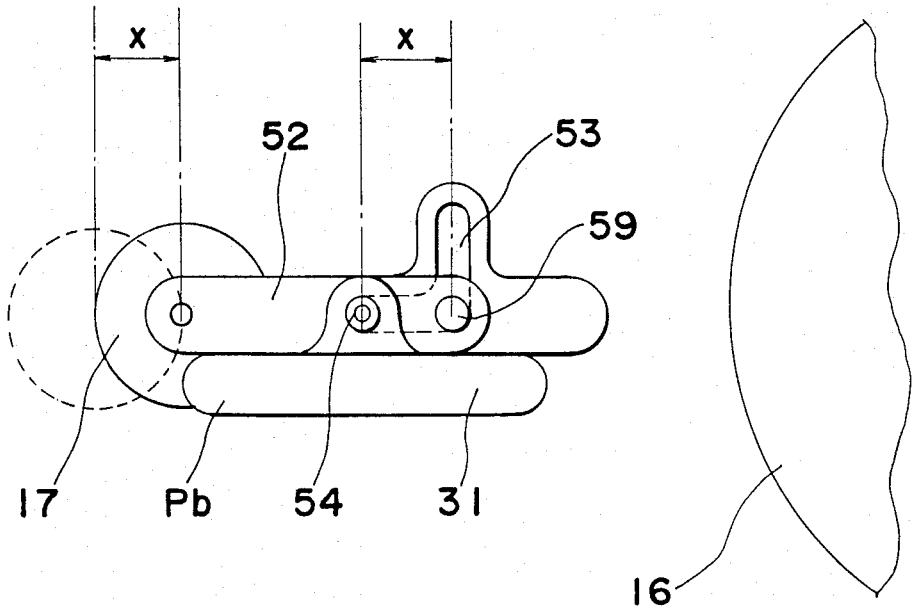

Referring to FIG. 13, a tension-applied condition is shown, in which tension lever 31 is held in the vertical position Pa. Under this condition, pin projection 59 is located above the stationary shaft 54. Referring also to FIG. 14, when tension lever 31 is rotated in the direction H about shaft 54, connection bar 58 is also rotated in the same direction. During the rotation of tension lever 31, shaft 54 and pin projection 59 slide along guide groove 53. Accordingly, by the rotation of tension lever 31, tension plate 52 is forced to move, against the biasing force of spring 57, towards right, thereby placing pin projection 59 on the right-hand side of shaft 54. When tension lever 31 is completely moved to the horizontal position Pb, as shown in FIG. 14, the tension plate 53 is moved rightwardly for a distance x which is equal to the distance between shaft 54 and pin projection 59. Accordingly, a distance between large roller 16 and small roller 17 is shortened by a distance x, thereby releasing the tension on a photoreceptor belt mounted on rollers 16 and 17. Accordingly, the old photoreceptor belt can be easily removed and a new photoreceptor belt can be mounted without any difficulty.

When it is necessary to apply the tension on the new photoreceptor belt again, lever 31 is rotated from the horizontal position to the vertical position. During the rotation of lever 31, pin projection 59 moves upwardly along groove 53 so as to shift tension plate 52 in the left-hand direction, aided by the biasing force of spring 57.

Next, the mechanism for effecting the automatic movement of lever 31 will be described hereinbelow.

Figure 15:
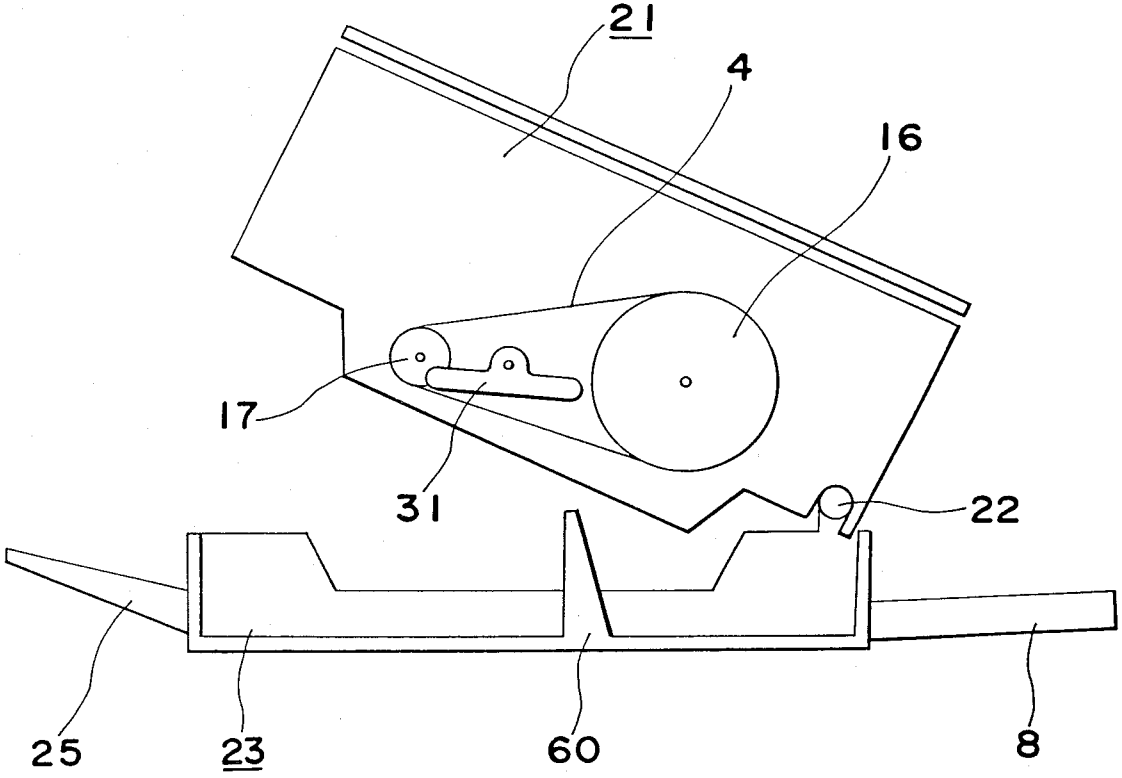
FIGS. 15 and 16 are side elevational views of the electrostatic copying machine according to the present invention, particularly showing positions when the upper compartment is lifted and when the same is seated on the lower compartment.
Figure 16:
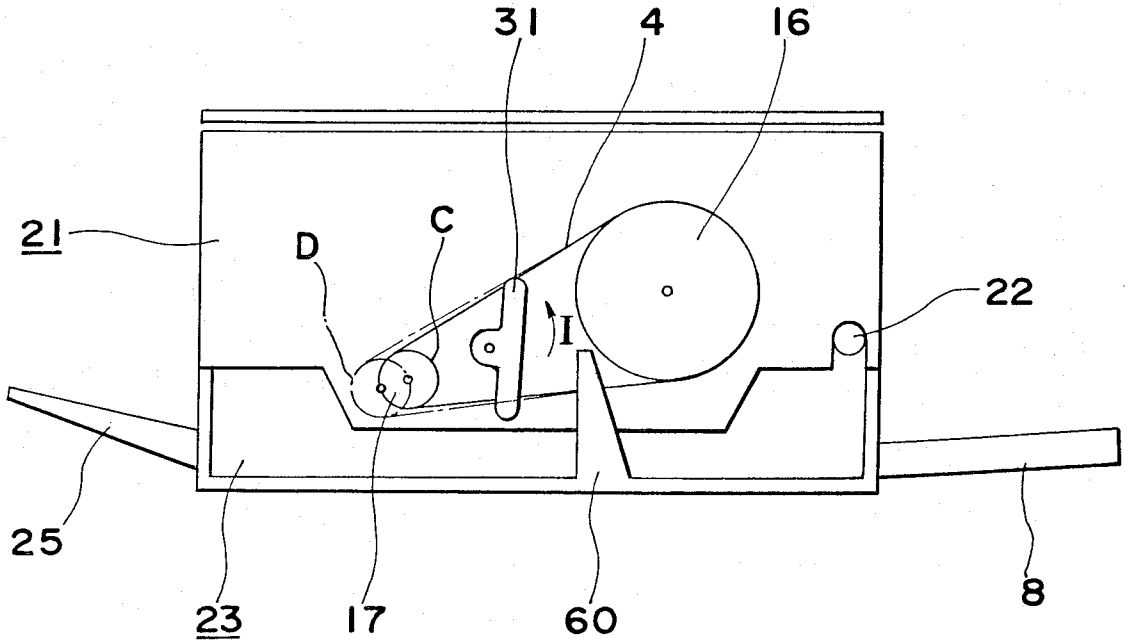

Referring to FIG. 15, lower frame 23 is provided with a projection 60 which extends upwardly from the bottom of lower frame 23 at a position such that, during the closing of upper frame 21, the tip of projection 60 comes into contact with a right-hand end portion of tension lever 31 held in the horizontal position. Accordingly, projection 60 pushes tension lever 31 to rotate counterclockwise in direction I, as indicated in FIG. 16. Thus, small roller 17 moves from the position C to position D, thereby automatically providing a tension to photoreceptor belt 4.

In the above described mechanism for effecting the automatic movements of lid 26 and lever 31, it is so adjusted that lid 26 closes first and then, lever 31 is rotated to the vertical position so as to avoid any false operation, such as described above in connection with FIG. 7.

Furthermore, according to the present invention, one end (rear end) of roller unit 24 is supported rigidly by the frame, and the other end (front end) thereof is freed when lid 26 opens, but is supported rigidly when lid 26 closes. The detail of the manner how roller unit 24 is supported will be described hereinbelow.

Referring to FIG. 17, roller unit 24 comprises a support frame 61, a front cover 62, and a top plate 63. Large roller 16 and small roller 17 are positioned between support frame 61 and front cover 62.

Referring to FIG. 18, the rear end of roller unit 24 is concealed by an outer frame 71, which is identical to the wall of upper frame 21. Outer frame 71 has an opening 72 formed therein, through which various parts can be viewed. Roller unit 24 is firmly supported on outer frame 71 such that support frame 61 is tightly secured to outer frame 71 using a plurality of screws 73. Shaft 51 of small roller 17 is loosely inserted through an elongated opening 64 formed in support frame 61, and is rotatably supported by a tension plate 65. Tension plate 65 has an L-shaped guide groove 66, which receives stationary shaft 54. A connection bar 67 has one end rotatably connected to the stationary shaft 54, which is inserted through an opening formed in support frame 61. The other end of connection bar 67 is provided with a pin projection 68 which is loosely inserted into guide groove 66. A suitable biasing means (not shown) is provided so as to urge the tension plate 65 in the right-hand direction when viewed in FIG. 18, i.e., in the direction for applying tension to photoreceptor belt 4.

Figure 19:
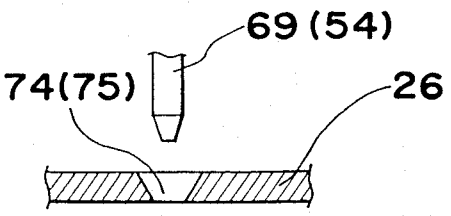
FIG. 19 is a diagrammatic view showing a tapered shaft to be journalled in a bearing.

A shaft 69, on which large roller 16 is mounted, has its front end portion rotatably supported by a bearing provided in front cover 62 (FIG. 17). The front end of shaft 69 is tapered, as best shown in FIG. 19, and is fed through an opening 74 formed in lid 26. For facilitating the insertion of the tapered end of sahft 69 each time lid 26 closes, opening 74 is also tapered, as depicted in FIG. 19. The rear end portion of shaft 69 is rotatably supported by a bearing 70 (FIG. 18) provided in support frame 61, and the rear end thereof is tapered so as to be fittingly and rotatably engaged in a tapered recess formed in outer frame 71. Furthermore, stationary shaft 54 has its front end portion extending outwardly from lever 31 and the front end thereof is tapered so as to be inserted through an opening 75 formed in lid 26. Preferably, opening 75 is also tapered for the easy insertion.

By the above arrangement, when lid 26 is opened, roller unit 24 is supported in upper frame 21 only at the rear end thereof, but firmly by screws 73 and by shaft 69 bearing in the tapered opening. Thus, while lid 26 is opened, the front end of roller unit 24 is free, thereby enabling an easy exchange of the photoreceptor belt 4. On the contrary, when lid 26 is closed, roller unit 24 is also supported at the front end thereof by the engagements between stationary shaft 54 and tapered opening 75 and also between shaft 69 and tapered opening 74. Thus, without providing a still structure for supporting the rollers, the rollers will not change their position even after a long period of use.

According to the present invention, the closing of lid 61, the positioning of the mounted photoreceptor belt 4, the applying of tension to the mounted photoreceptor belt 4 can be done automatically upon closing of upper frame 21. However, each of these steps can also be done individually.

It should be noted that the tension plate 65 and the parts associated thereto may be positioned outwardly through opening 72 formed in support frame 61.

Although the present invention has been fully described with reference to a preferred embodiment, many modifications and variations thereof will now be apparent to those skilled in the art, and the scope of the present invention is therefore to be limited not by the details of the preferred embodiment described above, but only by the terms of the appended claims.

What is claimed is:

1. A copying machine, comprising:

a roller unit including a driving roller and an idler roller positioned substantially parallel to each other, said roller unit having opposite ends in the axial direction of said rollers;

an upper frame for carrying said roller unit and a lower frame for supporting said upper frame, said upper frame being movable between an open position and a closed position with respect to said lower frame;

an endless photoreceptor belt mounted on said driving and idler rollers;

first supporting means for supporting one end of said roller unit;

moving means for moving said idler roller between a tension-released position, in which the distance between said driving roller and said idler roller is narrowed to loosely mount said photoreceptor belt thereon, and a tension-applied position, in which the distance between said driving roller and idler roller is widened to apply a predetermined tension to the mounted photoreceptor belt; and second supporting means provided to move between an attached position and detached position, such that when said second supporting means is in the attached position, said other end of said roller unit is supported by said supporting means and, when said second supporting means is in the detached position, said other end of said roller unit is free from attachment with said second supportin means, thereby enabling the removal and mounting of said endless photoreceptor belt in the axial direction of said rollers while said second supporting means is in said detached position.

2. The copying machine as claimed in claim 1, further comprising: forcing means provided in association with said second supporting means so that when said second supporting means moves to said attached position, said forcing means pushes the side of said endless photoreceptor belt to a properly mounted position.

3. The copying machine is claimed in claim 1, wherein said second supporting means is a lid member having an engaging means for the engagement with said other end of said roller unit, said lid member provided pivotally on a shaft, which is supported on said upper frame at a position below said roller unit and extends substantially perpendicular to the direction of movement of said upper frame to pivot between an engaged position and a disengaged position with respect to said roller unit.

4. The copying machine as claimed in claim 3, further comprising actuating means provided in said lower frame, said actuating means adapted to contact and push said lid member during the closing of said upper frame so as to automatically position said lid member to said engaged position when said upper frame is moved to said closed position.

5. The copying machine as claimed in claim 1, further comprising activating means provided in said lower frame, said activating means adapted to come into contact and activate said moving means during the closing of said upper frame so as to automatically move said idler roller to said tension-applied position when said upper frame is moved to said closed position.

6. A copying machine comprising:

an endless photoreceptor belt;

a roller unit including a driving roller positioned substantially parallel to each other for receiving said belt therearound, said roller unit having opposite ends in the axial direction of said rollers;

an upper frame for carrying said roller unit and a lower frame for supporting said upper frame, said upper frame being movable between an open position and a closed position with respect to said lower frame;

moving means for moving said idler roller between a tension-released position, in which the distance between said driving roller and idler roller is narrowed to loosely mount said photoreceptor belt therein, and a tension-applied position, in which the distance between said driving roller and idler roller is widened to apply a predetermined tension to the mounted photoreceptor belt;

first supporting means for supporting one end of said roller unit; and holding means for holding said moving means in said tension-applied position when said upper frame is moved to said closed position.

7. The copying machine as claimed in claim 6, further comprising:

second supporting means provided to move between an attached position and a detached position, such that when said second supporting means is in the attached position, said other end of said roller unit is supported by said second supporting means and when said second supporting means is in the detcahed position, said other end of said roller unit is free from attachment with said second supporting means, thereby enabling the removal and mounting of said endless photoreceptor belt in the axial direction of said rollers while said second supporting means is in said detached position.

8. The copying machine as claimed in claim 7, further comprising;

forcing means provided in association with said second supporting means so that when said second supporting means moves to said attached position, said forcing means pushes the side of said endless photoreceptor belt to a properly mounted position.

9. The copying machine as claimed in claim 7, wherein said holding means is provided on said second supporting means.

10. The copying machine as claimed in claim 7, wherein said second supporting means is a lid member having engaging means for engaging of said other end of said roller unit, a shaft supported on saiq upper frame at a position below said roller unit and extending substantially perpendicular to the direction of movement of said upper frame to pivot between an engaged position and a disengaged position with respect to said roller unit, said lid member being pivotally disposed on said shaft.

11. The copying machine as claimed in claim 10, further comprising:

actuating means provided in said lower frame, said actuating means being adapted to contact and push said lid member during the closing of said upper frame so as to automatically position said lid member to said engaged position when said upper frame is moved to said closed position.

12. The copying machine as claimed in claim 6, further comprising:

activating means provided in said lower frame, said activating means adapted to contact and activate said moving means during the closing of said upper frame so as to automatically move said idler roller to said tension-applied position when said upper frame is moved to said closed position.

13. The copying machine as claimed in claim 10, further comprising:

activating means provided in said lower frame, said activating means adapted to come into contact and activate said moving means during the closing of said upper frame so as to automatically move said moving means in an engaged position with respect to said holding means, thereby holding said lid member to the closed position when said upper frame is moved to said closed position.

* * * * *